US005257767A

United States Patent [19]

McConnell

[11] Patent Number: 5,257,767

[45] Date of Patent: * Nov. 2, 1993

[54] ADJUSTABLE SUPPORT MECHANISM FOR A KEYBOARD PLATFORM

[75] Inventor: Dale K. McConnell, Holland, Mich.

[73] Assignee: Waterloo Furniture Components, Ltd., Kitchener, Canada

[ * ] Notice: The portion of the term of this patent subsequent to Aug. 6, 2008 has been disclaimed.

[21] Appl. No.: 918,642

[22] Filed: Jul. 21, 1992

Related U.S. Application Data

[63] Continuation of Ser. No. 702,060, May 17, 1991, Pat. No. 5,145,136, which is a continuation-in-part of Ser. No. 537,422, Jun. 13, 1990, Pat. No. 5,037,054.

[51] Int. Cl.[5] ..... E04G 3/00

[52] U.S. Cl. ..... 248/284; 248/286; 248/918

[58] Field of Search ..... 248/284, 918, 286, 291, 248/293, 298, 281.1; 108/69, 75; 312/28

[56] References Cited

U.S. PATENT DOCUMENTS

| | | | |
|---|---|---|---|
| Re. 12,832 | 11/1914 | Vaaler . | |
| D. 209,139 | 11/1967 | Maurer et al. . | |
| D. 283,323 | 4/1986 | Cervero . | |
| D. 286,833 | 11/1986 | Cervero . | |
| D. 288,097 | 2/1987 | Harter et al. . | |
| 169,382 | 11/1875 | Starr . | |
| 187,361 | 2/1877 | Davis . | |
| 191,809 | 6/1877 | Moseley . | |
| 201,876 | 4/1876 | Ewart . | |
| 213,775 | 4/1879 | Redman et al. . | |
| 325,419 | 9/1885 | Langdon . | |
| 371,168 | 10/1887 | Boss . | |
| 399,220 | 3/1889 | Timroth . | |
| 441,560 | 11/1890 | Holloway . | |
| 466,464 | 1/1892 | Hood et al. . | |
| 484,401 | 10/1892 | Bolton . | |
| 491,610 | 2/1893 | Stuck . | |
| 540,516 | 6/1895 | Rowlett . | |
| 558,388 | 4/1896 | Heyward . | |
| 569,259 | 10/1896 | Walton et al. . | |
| 600,538 | 3/1898 | Kraemer . | |
| 612,987 | 10/1898 | Cary . | |
| 651,539 | 6/1900 | Warren | 248/284 X |
| 696,565 | 4/1902 | Horrocks . | |
| 719,625 | 5/1902 | Throm . | |
| 727,438 | 5/1903 | Piner . | |
| 790,207 | 5/1905 | Holtz . | |
| 818,982 | 4/1906 | Skelley . | |
| 851,659 | 4/1907 | Gaaikema | 312/28 |
| 894,298 | 7/1908 | Walker . | |
| 895,834 | 8/1908 | Aungst . | |
| 934,861 | 9/1909 | Vaaler . | |
| 967,877 | 8/1910 | Bauer . | |
| 973,325 | 10/1910 | Waring . | |
| 1,013,943 | 1/1912 | Kuenholdt . | |
| 1,037,627 | 9/1912 | Hunter | 312/28 |
| 1,050,672 | 1/1913 | MacIntosh . | |
| 1,061,707 | 5/1913 | Vaaler . | |
| 1,072,121 | 9/1913 | Hunter . | |
| 1,122,372 | 12/1914 | Duncan | 312/28 |
| 1,137,261 | 4/1915 | Dyke . | |
| 1,139,581 | 5/1915 | Riley . | |
| 1,246,859 | 11/1917 | Boyd . | |
| 1,286,241 | 12/1918 | Crowl . | |

(List continued on next page.)

FOREIGN PATENT DOCUMENTS

| | | |
|---|---|---|
| 1026723 | 2/1978 | Canada . |
| 1204420 | 5/1986 | Canada . |

(List continued on next page.)

OTHER PUBLICATIONS

"The New Workstation", by John Pile, *Interiors*, Nov. 1982, p. 92.

(List continued on next page.)

*Primary Examiner*—Ramon O. Ramirez
*Attorney, Agent, or Firm*—Allegretti & Witcoff, Ltd.

[57] ABSTRACT

An adjustable platform support mechanism for a keyboard includes a platform and a connecting assembly for the platform. The connecting assembly is attached to the platform by means of first and second pivotal connecting arms. The quadrilateral formed by connecting the pivots is in all instances a non-parallelogram. Thereby the platform, when moved from an extended position to a storage position, is pivoted upwardly in order to increase the space available in the kneehole underneath the desk. The shelf also features an adjustable tilt mechanism associated with keyboard platform support bracket so that the operator will be able to adjust the platform to any one of a number of tilt positions.

28 Claims, 3 Drawing Sheets

U.S. PATENT DOCUMENTS

| | | | |
|---|---|---|---|
| 1,318,677 | 10/1919 | Lemon . | |
| 1,348,924 | 8/1920 | Baskin . | |
| 1,375,867 | 4/1921 | Thompson . | |
| 1,441,439 | 1/1923 | Lorenzen . | |
| 1,442,664 | 1/1923 | Hansen . | |
| 1,480,484 | 1/1924 | Wertz . | |
| 1,532,715 | 4/1925 | Patrarca . | |
| 1,605,975 | 11/1926 | Tobey . | |
| 1,606,101 | 11/1926 | Russell . | |
| 1,606,975 | 11/1926 | Tobey . | |
| 1,691,552 | 11/1928 | Newnam . | |
| 1,733,107 | 10/1929 | Ahlberg . | |
| 1,888,034 | 11/1932 | Frankel . | |
| 2,024,045 | 12/1935 | Johnson . | |
| 2,073,998 | 3/1937 | Raby . | |
| 2,124,754 | 7/1938 | Simpson et al. . | |
| 2,160,289 | 5/1939 | Sagner . | |
| 2,173,302 | 9/1939 | Koch . | |
| 2,177,169 | 10/1939 | Brown . | |
| 2,194,889 | 3/1940 | De Lisle . | |
| 2,211,088 | 8/1940 | Arnold . | |
| 2,215,978 | 9/1940 | Schad . | |
| 2,251,198 | 7/1941 | Oneal . | |
| 2,271,241 | 1/1942 | Reitzel et al. . | |
| 2,287,577 | 6/1942 | Stava . | |
| 2,333,516 | 11/1943 | Brusilowsky . | |
| 2,356,924 | 8/1944 | Froelich . | |
| 2,377,279 | 5/1945 | Stewart . | |
| 2,408,387 | 10/1946 | Furry . | |
| 2,472,944 | 6/1949 | Furer et al. . | |
| 2,524,386 | 10/1950 | Johnston | 312/28 |
| 2,541,075 | 2/1951 | Koch . | |
| 2,543,485 | 2/1951 | Briggs . | |
| 2,551,305 | 5/1951 | Tompkins . | |
| 2,604,927 | 7/1952 | Bonnesen . | |
| 2,678,862 | 5/1954 | Paliuca . | |
| 2,710,782 | 6/1955 | Chaft . | |
| 2,710,783 | 6/1955 | Chaft | 312/28 |
| 2,727,562 | 12/1955 | Glascock . | |
| 2,802,540 | 8/1957 | Brookbank . | |
| 2,822,229 | 8/1958 | Carlson . | |

(List continued on next page.)

FOREIGN PATENT DOCUMENTS

| | | |
|---|---|---|
| 0010491 | 4/1980 | European Pat. Off. . |
| 0038068 | 4/1981 | European Pat. Off. . |
| 0046225 | 7/1981 | European Pat. Off. . |
| 0048404 | 9/1981 | European Pat. Off. . |

(List continued on next page.)

OTHER PUBLICATIONS

Advertisement: Portable Photocoagulator Log-3, *Archives of Ophthalmology*, Jun. 1981, vol. 99, No. 6.

Advertisement: Operational Lift-Off—Ritter ESCORT the complete ALL-AIR delivery system (Davis), *British Dental Journal*, vol. 151, No. 1, Jul. 7, 1981.

Advertisement: Perfection in Practice . . . New Belmont Compo 350, *British Dental Journal*, vol. 151, No. 1, Jul. 7, 1981.

Advertisement: Baylor Visual Fields Programmer, *Archives of Ophthalmology*, Aug. 1981, vol. 99, No. 8.

Advertisement: SOVEREIGN—Modular, Expandable, Compact, Unique, Versatile, Reliable (Sherwood Instruments, Inc.), *Dental Economics*, vol. 71, No. 9, Sep. 1981, p. 47.

Advertisement: If you think flexibility, efficiency, mean high cost, think again. ACCESS Delivery Systems. Suit your style and your budget. (S. S. White Pennwalt), *Dental Products Report*, vol. 15 (No. 9), Sep. 1981, pp. 66-67.

Advertisement: 70/90 kVp x-ray unit (General Electric), *Dental Products Report*, vol. 15 (No. 9), Sep. 1981.

Advertisement: Modern Equipment For The Changing Frontiers of Opthalmology by DMI, *Opthalmology Times*, Sep. 1981, vol. 6, No. 9.

Advertisement: Mobile, stable and optically unique: Surgical operating microscopes of the Wild M 600 Series, *American Journal of Ophthalmology*, Sep. 1981, vol. 92, No. 3.

Advertisement: Compare: EC-450/504 Dentist/Hygienist Systems with the Competition (ZIRC Dental Products), *Dental Products Report*, vol. 15 (No. 10), Oct. 1981, p. 99.

Advertisement: To Develop Delivery Systems For Today, We Went Back to Basics (Engle Dental Systems), *Proofs*, Nov./Dec. 1981.

Advertisement: Follow the Leader—Philips Oralix 65 . . . leading the way in versatility, *Proofs*, Nov./Dec. 1981.

Advertisement: A-Dec Equipment for Over-the-Patient Delivery—A new approach to instrument delivery systems in the A-dec tradition of quality and reliability, *Dental Products Report Annual*, vol. 14 (No. 11), 1981.

(List continued on next page.)

U.S. PATENT DOCUMENTS

| | | |
|---|---|---|
| 2,863,594 | 12/1958 | Shafer . |
| 2,914,244 | 11/1959 | Wheeler . |
| 2,954,092 | 9/1960 | Thornton-Trump . |
| 2,997,242 | 8/1961 | Grosholz . |
| 3,003,838 | 10/1961 | Chaft . |
| 3,021,185 | 2/1962 | Kowalczyk . |
| 3,032,304 | 5/1962 | Machlan . |
| 3,054,187 | 9/1962 | Staunt . |
| 3,079,726 | 3/1963 | May . |
| 3,095,061 | 6/1963 | Gregory . |
| 3,140,559 | 7/1964 | Grow et al. . |
| 3,172,551 | 7/1964 | Wolfe . |
| 3,195,731 | 7/1965 | Bomar, Jr. . |
| 3,332,513 | 7/1967 | Wiebe . |
| 3,337,000 | 8/1967 | Giladi et al. . |
| 3,357,517 | 12/1967 | Wagner . |
| 3,359,575 | 12/1967 | Nielsen . |
| 3,418,714 | 3/1968 | Pietschmann . |
| 3,425,761 | 2/1969 | Schreyer . |
| 3,426,190 | 2/1969 | Bobrick . |
| 3,436,046 | 4/1969 | Valeska . |
| 3,452,528 | 7/1969 | Fairchild et al. . |
| 3,516,343 | 6/1970 | Tunney . |
| 3,530,513 | 9/1970 | Mauer et al. . |
| 3,550,976 | 12/1970 | Rauser, Sr. et al. . |
| 3,565,372 | 2/1971 | Jones et al. . |
| 3,575,483 | 4/1971 | Church et al. . |
| 3,610,673 | 10/1971 | Strombeck et al. . |
| 3,650,350 | 3/1972 | Frick . |
| 3,652,143 | 3/1972 | Wener . |
| 3,778,125 | 12/1973 | Gutman, Jr. et al. . |
| 3,823,475 | 7/1974 | Heubeck . |
| 3,830,352 | 8/1974 | Kolpek . |
| 3,856,108 | 12/1974 | Grove . |
| 3,860,280 | 1/1975 | Karlsson . |
| 3,891,301 | 6/1975 | Heller . |
| 3,902,034 | 8/1975 | Isozaki . |
| 3,971,140 | 7/1976 | Martinez . |

(List continued on next page.)

FOREIGN PATENT DOCUMENTS

| | | |
|---|---|---|
| 0094376 | 6/1983 | European Pat. Off. . |
| 0096373 | 12/1983 | European Pat. Off. . |
| 2320344 | 11/1974 | Fed. Rep. of Germany . |
| 2530603 | 1/1977 | Fed. Rep. of Germany . |
| 2717290 | 10/1978 | Fed. Rep. of Germany . |
| 2836655 | 10/1979 | Fed. Rep. of Germany . |
| 7931786 | 10/1979 | Fed. Rep. of Germany . |

(List continued on next page.)

OTHER PUBLICATIONS

Advertisement: You can't beat the system for the price. Pelton Crane, *Dental Products Report Annual*, vol. 14 (No. 11), 1981.

Advertisement: Macro Dental Products, *Dental Products Report Annual*, vol. 14 (No. 11), 1981.

Catalog: Desk Hardware—Secretarial Desk Typewriter Attachment for Steel or Wooden Desks, Waterloo Metal Stampings catalog, p. 26.

Catalog: Convertible Fittings, Excerpt from a Hafele catalog.

Catalog: TV-O-Matic Recliners, Waterloo Metal Stampings Ltd.

Advertisement: The Ultimate (Den-Tal-Ez), *Proofs*, Jan. 1977.

Advertisement: New From Marco—Smart Idea, *Dental Products Report*, vol. 11, No. 1, Jan. 1977, p. 74.

Advertisement: The Ultimate (Den-Tal-Ez), *Dental Products Report*, vol. 11 (No. 1), Jan. 1977.

Advertisement: Instrument Delivery of the Century—The Century Uni-Chair from A-dec . . . The Delivery Systems Company, *Dental Products Report*, vol. 11 (No. 1), Jan. 1977.

Advertisement: Make It Easier For Yourself and Save Thousands—Parkell's New TracMatic Delivery Station, *Dental Products Report*, vol. 11 (No. 1), Jan. 1977.

Advertisement: Siemens Operatory System (Siemens Corp.), *Dental Products Report*, vol. 11 (No. 1), Jan. 1977.

Advertisement: The Regency-Consort System (S. S. White Dental Products), *Dental Products Report*, vol. 11 (No. 1), Jan. 1977, cover page.

Advertisement: The Ritter X-100 Chair and 180 Unit . . . reliable together, proven together, made to simplify your work flow together (Sybron/Ritter), *Dental Products Report*, vol. 11, (No. 2), Feb. 1977.

Advertisement: Doctor, you be the judge! Which Bargain is Better? (Vacudent), *Dental Products Report*, vol. 11 (No. 2), Feb. 1977, p. 77.

Advertisement: Neu Kavo Estetic 1024, *Dental Echo*, vol. 47 (No. 1), Feb. 1977.

Advertisement: Modell 180, ein Universalgerat furjede Praxis jetzt auch in Deutschland (Stern Weber), *Dental Echo*, vol. 47 (No. 1), Feb. 1977, p. 43.

(List continued on next page.)

U.S. PATENT DOCUMENTS

| | | | |
|---|---|---|---|
| 3,986,755 | 10/1976 | Kohara . | |
| 3,995,797 | 12/1976 | Knight . | |
| 4,018,487 | 4/1977 | Orr et al. . | |
| 4,073,240 | 2/1978 | Fly . | |
| 4,082,244 | 4/1978 | Groff . | |
| 4,088,200 | 5/1978 | Cowely et al. . | |
| 4,089,573 | 5/1978 | Aeschliman . | |
| 4,098,371 | 7/1978 | Cox . | |
| 4,118,766 | 10/1978 | Kredo . | |
| 4,158,490 | 6/1979 | Gottschalk et al. . | |
| 4,172,551 | 10/1979 | Johnson . | |
| 4,208,028 | 6/1980 | Brown . | |
| 4,226,486 | 10/1980 | Roberts et al. . | |
| 4,266,747 | 5/1981 | Souder, Jr. et al. . | |
| 4,307,672 | 12/1981 | Shikimi . | |
| 4,314,728 | 2/1982 | Faiks . | |
| 4,316,082 | 2/1982 | Fritz . | |
| 4,334,482 | 6/1982 | Bolduc . | |
| 4,365,561 | 12/1982 | Tellier et al. . | |
| 4,379,429 | 4/1983 | Gubbe et al. . | |
| 4,384,532 | 5/1983 | Staff . | |
| 4,390,206 | 6/1983 | Faiks et al. . | |
| 4,402,481 | 9/1983 | Sasaki . | |
| 4,428,631 | 1/1984 | Cope et al. . | |
| 4,437,638 | 3/1984 | Scheibenpflug . | |
| 4,447,031 | 5/1984 | Souder, Jr. et al. . | |
| 4,449,611 | 5/1984 | Frey-Wigger . | |
| 4,456,212 | 6/1984 | Raftery . | |
| 4,496,200 | 1/1985 | Hagstrom et al. . | |
| 4,511,111 | 4/1985 | Godfrey et al. . | |
| 4,515,086 | 5/1985 | Kwiecinski et al. . | |
| 4,518,059 | 5/1985 | Frey-Wigger . | |
| 4,546,708 | 10/1985 | Wilburth . | |
| 4,550,666 | 11/1985 | Svoboda . | |
| 4,562,987 | 1/1986 | Leeds et al. . | |
| 4,597,681 | 7/1986 | Hodges . | |
| 4,604,955 | 8/1986 | Fleischer et al. . | |
| 4,616,798 | 10/1986 | Smeenge et al. ..... | 248/918 X |

(List continued on next page.)

FOREIGN PATENT DOCUMENTS

| | | |
|---|---|---|
| 2847135 | 5/1980 | Fed. Rep. of Germany . |
| 3137515 | 4/1983 | Fed. Rep. of Germany . |
| 3506381 | 8/1986 | Fed. Rep. of Germany . |
| 0588023 | 4/1925 | France . |
| WO83/01183 | 4/1983 | PCT Int'l Appl. . |
| 576890 | 6/1976 | Switzerland . |
| 1452940 | 10/1976 | United Kingdom . |

(List continued on next page.)

OTHER PUBLICATIONS

Advertisement: Sirona S5—Now we have it for you . . . talk to your dental dealer (Siemens Corp.), *Dental Products Report*, vol. 11 (No. 3), Mar. 1977, p. 35.

Advertisement: Joy Light (Vacudent), *Dental Products Report*, vol. 11 (No. 3), Mar. 1977.

Advertisement: Modell 180, ein Universalgerat furjede Praxis jetzt auch in Deutschland, *Dental Echo*, vol. 47 (No. 2), Mar. 1977, p. 79.

Advertisement: OMS Flex 2—Litema-Dentalvertrieb, *Dental Echo*, vol. 47 (No. 3), May 1977, p. 147.

Advertisement: Instrument Delivery of the Century. The Century Uni-Chair from A-dec . . . The Delivery Systems Company, *Proofs*, Sep. 1977.

Advertisement: For dependability, simplicity and versatility . . . The Ensemble by Vacudent . . . stands alone, *Proofs*, Sep. 1977.

Advertisement: Instrument Delivery System is here—The New Perception Unit (Chayes Virginia), *Dental Products Report*, vol. 11 (No. 9), Oct. 1977.

Advertisement: The World's Most Advanced Chair—The New Vision Chair (Chayes Virginia), *Dental Products Report*, vol. 11 (No. 9), Oct. 1977.

Advertisement: Coastal Sprint delivery system (Chemetron Dental Products), *Dental Products Report*, vol. 11 (No. 9), Oct. 1977.

Advertisement: The Perception Unit (Chayes Virginia), *Dental Products Report*, vol. 11 (No. 9), Oct. 1977, cover page.

Advertisement: Introducing Opus 1—The System that delivers more than simplicity (Star Dental), *Dental Products Report Annual*, vol. 10 (No. 11), 1977.

Advertisement: Doctor, you be the judge! Which Bargain is Better? (Vacudent), *Dental Products Report Annual*, vol. 10 (No. 11), 1977, p. 49.

Advertisement: The Equipment: Midwest nerican Dental Units. The full line of flexible, efficient dental units—each delivering instruments efficiently to the center of the Delivery Corridor, *Dental Products Report Annual*, vol. 10 (No. 11), 1977.

Advertisement: The Ultimate, *Dental Products Report Annual*, vol. 10 (No. 11), 1977.

Advertisement: Philips New Oralix 65 . . . It Gives You the Business, *Proofs*, Jan. 1978.

(List continued on next page.)

U.S. PATENT DOCUMENTS

| | | | |
|---|---|---|---|
| 4,625,657 | 12/1986 | Little et al. | 108/93 |
| 4,632,349 | 12/1986 | Anstey | 248/918 X |
| 4,635,893 | 1/1987 | Nelson | 248/558 |
| 4,638,969 | 1/1987 | Brown . | |
| 4,644,875 | 2/1987 | Watt . | |
| 4,676,339 | 6/1987 | Rybka et al. . | |
| 4,691,888 | 9/1987 | Cotterill | 248/284 |
| 4,706,919 | 11/1987 | Soberalski et al. | 248/918 X |
| 4,708,312 | 11/1987 | Rohr | 248/921 X |
| 4,776,284 | 10/1988 | McIntosh . | |
| 4,826,123 | 5/1989 | Hannah et al. . | |
| 4,843,978 | 7/1989 | Schmidt et al. . | |
| 4,923,259 | 5/1990 | Bartok . | |
| 5,037,054 | 8/1991 | McConnell | 248/284 |
| 5,145,136 | 9/1992 | McConnell | 248/284 |

(List continued on next page.)

FOREIGN PATENT DOCUMENTS

| | | |
|---|---|---|
| 1509192 | 5/1978 | United Kingdom . |
| 1601246 | 10/1981 | United Kingdom . |
| 2154442A | 9/1985 | United Kingdom . |
| 2176996 | 1/1987 | United Kingdom . |
| 2176996B | 7/1989 | United Kingdom . |

OTHER PUBLICATIONS

Advertisement: Coastal Sprint (Chemetron Dental Products), *Proofs*, Feb. 1978.

Advertisement: Sprint Flex System II (Chemetron), Dental Products Report—Products and News for the Dental Profession, vol. 12 (No. 3), Mar. 1978, p. 106.

Advertisement: Now discover for yourself what this dentist from Atlanta found in the African bush. He was talking about Trac 3, the operatory equipment with functional simplicity and rugged reliability. (Parkell), *Dental Products Report*, vol. 12 (No. 3), Mar. 1978.

Advertisement: Tradition of Excellence—A-Dec Century Uni-Chair, *Proofs*, Mar. 1978.

Advertisement: Dansereau Dental, *Dental Products Report*, vol. 12 (No. 7), Jul./Aug., 1978, p. 84.

Advertisement: Introducing Philips Oralix 65 . . . A glimpse into the future, *Dental Products Report*, vol. 12 (No. 8), Sep. 1978, p. 72.

Advertisement: Instrument Delivery of the Century (A-Dec), *Dental Products Report Annual*, vol. 11 (No. 11), 1978.

Advertisement: No two dentists are alike . . . Now no dental equipment systems have to be the same, either! (Vacudent), *Dental Economics*, vol. 69, No. 5, May 1979.

Advertisement: The Concept—MDT Operatory Equipment, *Dental Economics*, vol. 69, No. 2, Feb. 1979.

Advertisement: Gravity Flow Cupidor (Marco Dental Products), *Proofs*, Jun. 1979, p. 13.

Advertisement: The Unitrac (MDT Corp.), *Dental Products Report Annual*, vol. 12 (No. 11), 1979, p. 66.

Advertisement: The Simplicity (Sherwood Instruments, Inc.), *Dental Products Report Annual*, vol. 12 (No. 11), 1979, p. 66.

Advertisement: A Delivery System with Executive Styling and Ranger Versatility (Pelton & Crane), *1980 Dental Dealers' Directory*.

Advertisement: Space-Saver 6000 (Macro Dental Products), *Dental Products Report*, vol. 14 (No. 1), Jan. 1980, p. 102.

Advertisement: Sirona S5 Dental Unit From Siemens, *Dental Products Report*, vol. 14 (No. 1), Jan. 1980, p. 64.

Advertisement: Avoid the High Cost of Buying Less . . . A most complete two handpiece delivery system that is very, very affordable—Ranger Model 230 and Basic Cuspidor Model 306 (Pelton & Crane), *Dental Products Report*, vol. 14 (No. 1), Jan. 1980.

Advertisement: $3900 Operatory (Dansereau Dental), *Dental Products Report*, vol. 14 (No. 1), Jan. 1980, p. 42.

Advertisement: New From Marco, Smart Idea—Regal IV Unit, *Dental Products Report*, vol. 11 (No. 1), Jan. 1977.

Advertisement: Side-Delivery System (Exec-Aire; Pelton & Crane), *Dental Products Report*, vol. 14 (No. 1), Jan. 1980.

Advertisement: Your Looking Good—Truth System(s) Operatory Modules, *Dental Products Report*, vol. 14 (No. 12), Feb. 1980, p. 102.

Advertisement: Why Dentists Who Buy Parkell Equipment Have Enough Money Left Over To Enjoy the Good Life, *Dental Products Report*, vol. 14 (No. 12), Feb. 1980.

Advertisement: X-Ray Unit—The Raflex 70, *Dental Products Report*, vol. 14 (No. 12), Feb. 1980.

Advertisement: Practice Made Perfect With "Group 6" From CVI—The Dynamic Ventura Chair, Accessa (List continued on next page.)

OTHER PUBLICATIONS

Assistant's Services Center, Perception Cart Delivery System, Console Work Station, Operator and Assistant Stools, *Dental Products Report,* vol. 14 (No. 4), Apr. 1980.

Advertisement: The Excalibur 023/052 Operatory Package: The 0052 Delivery System, *Dental Products Report,* vol. 14 (No. 5), May 1980, p. 98.

Advertisement: A-Dec Equipment For Side Delivery—A new approach to instrument delivery systems in the A-dec tradition of quality and reliability: Doctor's Cabinet or Wall 3010, *Dental Products Report,* vol. 14 (No. 5), May 1980.

Advertisement: Modular Delivery Center (Belmont Equipment Corp.), *Dental Products Report,* vol. 14 (No. 5), May 1980, cover page.

Advertisement: Basic 4 Unit (MDT Corporation), *Dental Products Report,* vol. 14 (No. 7), Jul./Aug. 1980, p. 24.

Advertisement: Doctor's Console (Marco Dental Products), *Dental Products Report,* vol. 14 (No. 7), Jul./Aug. 1980.

Advertisement: Modern Instrument Delivery Shouldn't Hinge On Something So Old-Fashioned As Springs—Macro Dental Products Introduces the Freelok Arm Positioning System, *Proofs,* Sep. 1980.

Advertisement: Modern Instrument Delivery Shouldn't Hinge On Something So Old-Fashioned As Springs—Macro Dental Products Introduces the Freelok Arm Positioning System, *Dental Products Report,* vol. 14 (No. 8), Sep. 1980.

Advertisement: The DayLight Dental Light, *Dental Products Report,* vol. 14 (No. 8), Sep. 1980.

Advertisement: Biotec and Royal . . . bring you the best of both worlds—The "Distinctive Series", *Dental Products Report,* vol. 14 (No. 9), Oct. 1980, p. 63.

Advertisement: The Excalibur 058 Delivery System—Designed for the 1980's and beyond, *Dental Products Report Annual,* vol. 13 (No. 11), 1980.

Advertisement: Coastal we've got what you want, *Dental Products Report Annual,* vol. 13 (No. 11), 1980.

Advertisement: Introducing the Ritter Escort—An exclusive system that sets new standards for simplicity and versatility, *Dental Products Report Annual,* vol. 13 (No. 11), 1980.

Catalog: Gas Lift Table, From Karl Gutmann, Inc. 1981.

Advertisement: There's no such thing as a single delivery system for every doctor (A-Dec), *Dental Products Report,* vol. 14 (No. 15), Jan. 1981, pp. 42-43.

Advertisement: Now Standing All Alone . . . The New Macro Chair & Stand, *Archives of Ophthalmology,* Jan. 1981, vol. 99, No. 1.

Advertisement: For Complete certainty . . . the Original Goldmann by Haag—Streit, *American Journal of Ophthalmology,* Jan. 1981, vol. 91, No. 1.

Advertisement: Because you asked for it, Doctor . . . Better Prices! Better Service! (Vacudent), *Dental Products Report*—Products and News for the Dental Profession, vol. 15 (No. 2), Feb. 1981.

Advertisement: Coastal Wants To Give You A $1113 Graduation Present—Sprint Deluxe System, *Dental Products Report,* vol. 15 (No. 2), Feb. 1981, p. 70.

Advertisement: Jos. Dansereau Mfg. Co. Gives you American Ingenuity with Quality, *Dental Products Report,* vol. 15 (No. 2), Feb. 1981, p. 46.

Advertisement: Panoramic x-ray unit, *Dental Products Report,* vol. 15 (No. 2), Feb. 1981.

Advertisement: Siemens Studio 3000, *Dental Echo,* Feb. 1981, pp. 29-30.

Advertisement: Reliance Equipment Presents The 80's, *Archives of Ophthalmology,* Feb. 1981, vol. 99, No. 2, p. 217.

Advertisement: Coburn/Rodenstock, *Archives of Ophthalmology,* Mar. 1981, vol. 99, No. 3, p. 544.

Advertisement: The Bausch & Lomb Ophthalmic Chair and Instrument Stand . . . in a word, "Professional.", *Archives of Ophthalmology,* vol. 1981, vol. 99, No. 4.

Advertisement: The Ritter Escort Unit System—It Means Greater Operatory Flexibility For You Through: Versatility, Proven Reliability, Wide Choice of Mounts and Arms, *Proofs,* May 1981.

Article: Combined Modular System No. 5a, *Dental Echo,* vol. 50 (No. 3), May 1981.

Article: The Revina Operatory, *Dental Echo,* vol. 50 (No. 3), May 1981, p. 104.

Advertisement: Bausch & Lomb—The Ophthalmic Line, *Archives of Ophthalmology,* May 1981, vol. 99, No. 5.

Advertisement: The New Marco Chair and Stand . . . Attractive, Versatile, Economical, *American Journal of Ophthalmology,* vol. 92, No. 5, Nov., 1981.

International Search Report, compiled by the European Patent Office for International Application No. PCT/US91/03148.

Fig. 1
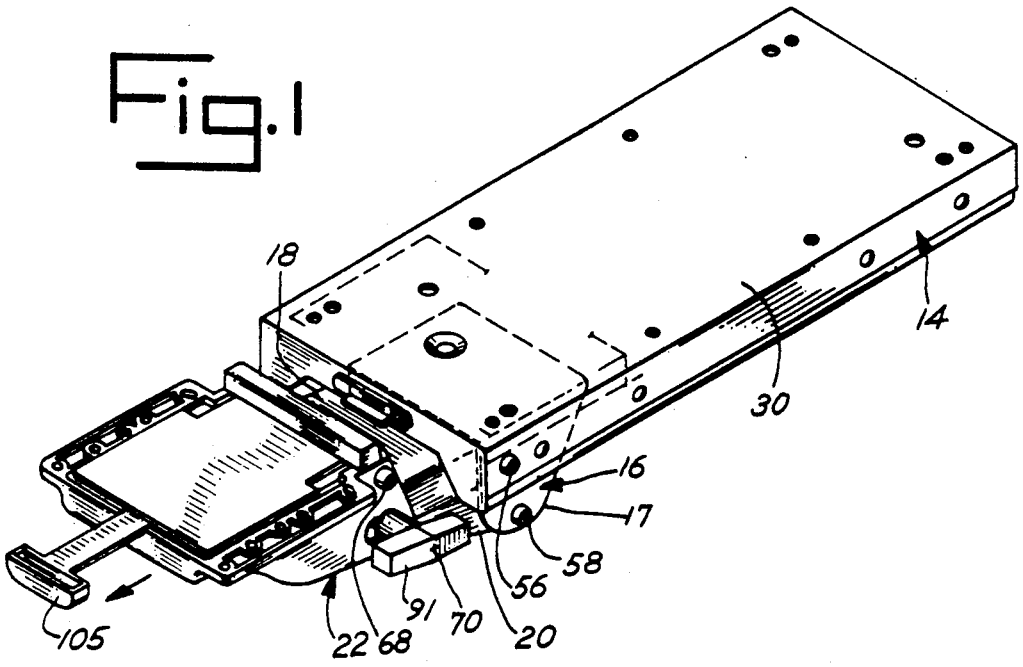
Fig. 2
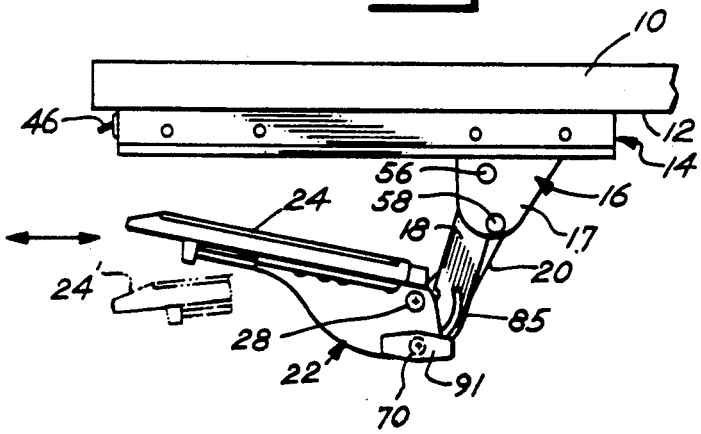
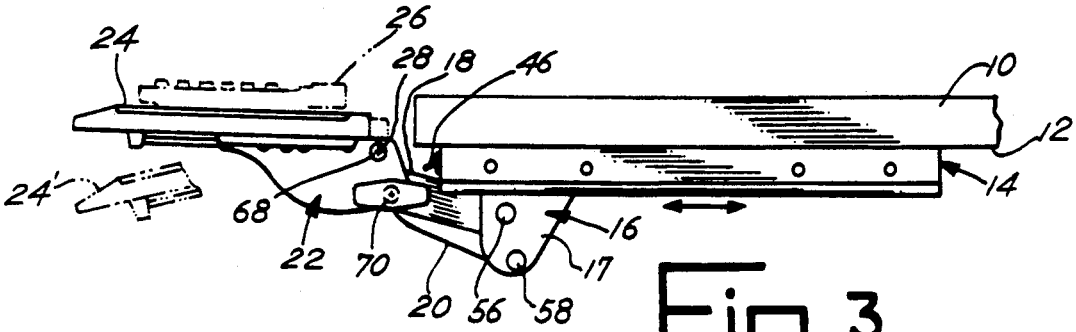
Fig. 3

ADJUSTABLE SUPPORT MECHANISM FOR A KEYBOARD PLATFORM

This is a continuation of my earlier filed, copending patent application, Ser. No. 07/702,060, filed May 17, 1991 . Now U.S. Pat. No. 5,145,136 which was a continuation-in-part of my earlier filed copending patent application, Ser. No. 07/537,422, filed Jun. 13, 1990, now issued as U.S. Pat. No. 5,037,054.

BACKGROUND OF THE INVENTION

This invention relates to an improved adjustable support mechanism for a keyboard platform or the like.

Heretofore there have been available various mechanisms for supporting keyboards associated with computer terminals. One such device is disclosed in Smeenge, U.S. Pat. No. 4,616,798, entitled: Adjustable Support For CRT Keyboard, wherein a keyboard support mechanism comprises first and second sets of parallel, equal length arms which link first and second brackets associated respectively with a keyboard platform and a sliding plate attached beneath a desk. The parallel arms maintain the support platform in a generally horizontal position regardless of the orientation of the arms. During storage of the support platform, the platform is pivoted to a retracted position beneath the desk top. During use, the keyboard platform is pivoted forward toward an extended position. Because of the equal length, parallel arm arrangement, the keyboard platform is always maintained in a horizontal position. The bracket supporting the inside ends of the arms beneath the desk may be slidably attached to a support plate attached to the bottom side of the desk. In this manner, the assembly may be slid beneath the desk top for storage.

Such a parallel arm mechanism has proven to be useful. However, it does limit access in the kneehole beneath the desk for an operator because the shelf is maintained in a horizontal position when in the retracted position. Thus, there has remained a need for an improved keyboard platform support mechanism which provides improved access to the kneehole opening under a desk top when the keyboard is positioned in the storage position beneath the desk top in the kneehole. The present invention provides such an improved mechanism.

SUMMARY OF THE INVENTION

In a principal aspect, the improved shelf or platform support mechanism for a keyboard of the present invention comprises a bracket which is slidably mounted on a plate for attachment beneath a desk top. The slide bracket includes first and second speed pivots. A keyboard platform likewise includes a platform bracket with first and second speed pivots. A first linkage arm connects the first pivots. A second linkage arm connects the second pivots. The second linkage arm is positioned vertically below the first arm and is generally not parallel to the first arm. The non-parallel arrangement is effected by either (1) having the upper and lower pivots of each bracket spaced a different distance or (2) the lower arm having a greater length than the upper arm or (3) a combination of (1) and (2). The linkage provides that the keyboard platform will vary in orientation whenever the link arms are pivoted. Thus, when the platform is moved from an extended or operator use position to a retracted or storage position by pivoting of the arms, the movement the second arm relative to the first will cause the platform to tilt upwardly from horizontal, thus providing more room in the kneehole beneath desk top. To accommodate the fact that the platform does not remain in a generally constant orientation when the linkage arms are pivoted, the platform itself is pivotally attached to its bracket. The platform may be pivoted about its first pivot to adjust its orientation of any of a number of detent positions. Thus, a spring biased detent mechanism permits orientation of the keyboard support platform in a number of non-horizontal as well as a horizontal position in accord with the desire of the keyboard operator. In the preferred embodiment the support plate is slidably mounted for storage of the entire mechanism and platform beneath the desk top. The support plate may also be pivoted about a vertical axis. A locking mechanism is also included for locking the support plate and the support mechanism in the extended position. A hand operated locking member is available to lock the linkage arms in any desired orientation. The arms are typically biased toward the extended position by means of mechanical springs, air or fluid springs.

Thus, it is an object of the invention to provide an improved adjustable support mechanism for a keyboard platform.

A further object of the invention is to provide an improved platform support mechanism for a keyboard which includes generally non-parallel linkage arms connecting the keyboard assembly with the assembly which attaches to the lower side of a desk top.

Yet another object of the invention is to provide an improved keyboard support assembly wherein the support mechanism for the keyboard includes a first linkage arm connecting upper pivot points associated with respective brackets of a keyboard platform and a slide plate and lower pivot points associated with the same brackets wherein the lower pivot point and upper pivot point of the platform bracket are differently spaced the lower pivot point and upper pivot point of the bracket for the slick plate.

Another object of the invention is to provide a support mechanism which provides for improved ease of storage of the keyboard support platform relative to the known prior art, yet which is may be easily positioned in an orientation for use.

Another object of the invention is to provide an improved keyboard platform support mechanism which includes an easily adjustable mechanism for altering the angle or tilt of the platform, and which also includes an easily adjustable and accessible mechanism for locking or holding the support linkage in a fixed position.

Yet another object of the invention is to provide an improved keyboard platform support mechanism of simplified and rugged construction which is easily assembled, easily manufactured, durable, and useful.

Another object is to provide a keyboard platform support mechanism which is biased by spring means toward a storage or a work position.

These and other objects, advantages and features of the invention will be set forth in a detailed description which follows.

BRIEF DESCRIPTION OF THE DRAWINGS

In the detailed description which follows, reference will be made to the drawing comprised of the following FIGURES:

FIG. 1 is a perspective view of the mechanism of the invention;

FIG. 2 is a side elevation of the support mechanism of the invention attached to the underside of a desk and in the retracted position;

FIG. 3 is a side elevation of the support mechanism of the invention attached to the underside of a desk and in the extended position with the keyboard support mechanism illustrated in alternative positions in phantom;

DESCRIPTION OF THE PREFERRED EMBODIMENT

Figure 4:
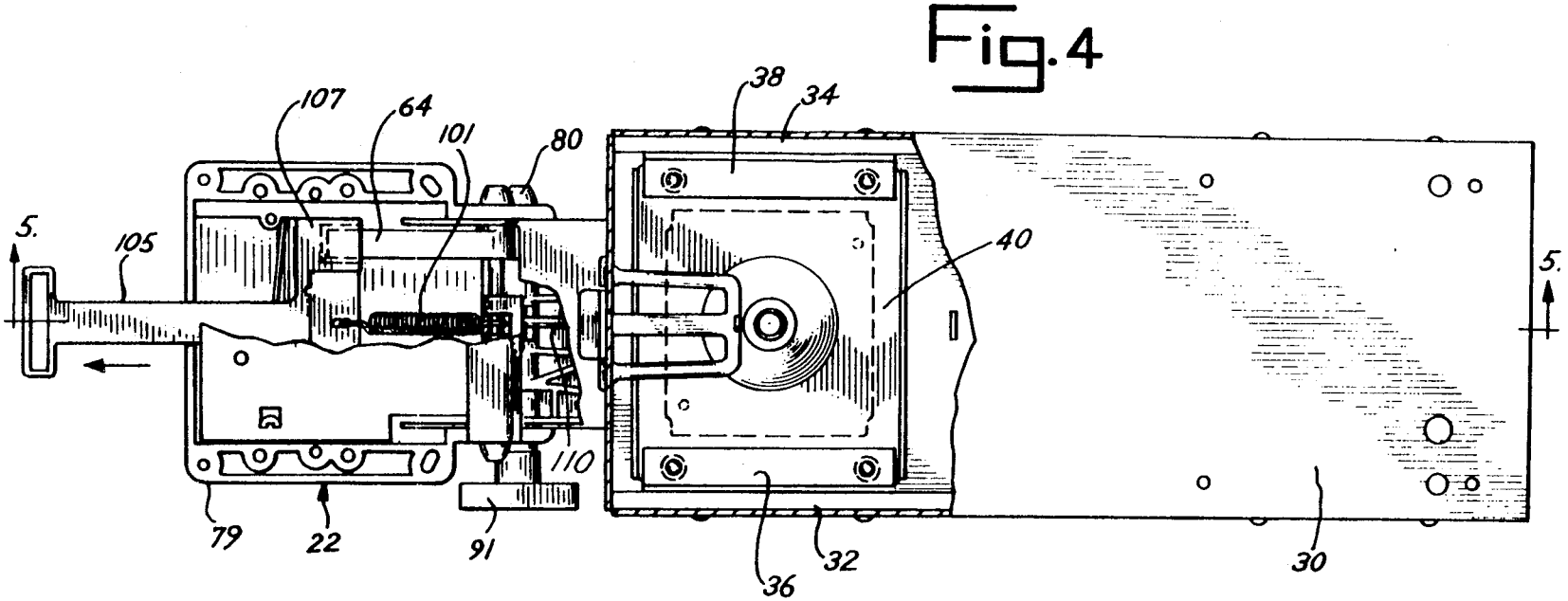
FIG. 4 is a top plan view of the support mechanism of the invention.

Before describing the component parts of the mechanism of the invention, a brief description of the manner in which the mechanism operates will be beneficial in illustrating the construction of the invention. Reference is thus directed to FIGS. 1, 2 and 3. As shown in FIG. 2 there is illustrated a desk top 10. Attached to the underside 12 of the desk top 10 is a plate assembly 14. The plate assembly 14 supports a sliding bracket mechanism 16. The sliding bracket mechanism 16 supports the remainder of the support mechanism for the keyboard platform and is slidable between a retracted position as depicted in FIG. 2 and an extended position as depicted in FIG. 3. In the preferred embodiment, the sliding bracket mechanism 16 is also pivotable about a vertical axis as will be described in more detail below.

The sliding bracket mechanism 16 which depends from the plate assembly 14 has a first linkage arm 18 pivotally attached thereto. Arm 18 is also referred to as an upper linkage arm 18. A second linkage arm 20 is also pivotally attached to bracket mechanism 16 and may be referred to as a lower linkage arm 20. The first and second linkage arms 18, 20 are also pivotally attached to a keyboard platform assembly 22 at upper and lower pivot connections respectively. The keyboard platform assembly 22, as will be described in greater detail below, is comprised of brackets which are attached to the remainder of the mechanism forming the assembly 22. The keyboard platform assembly 22 supports a keyboard platform 24. The keyboard platform 24 is designed to support a computer keyboard 26 as shown in phantom in FIG. 3. A keyboard 26 thus is typically positioned on the platform 24.

Movement of the platform assembly between the positions of FIG. 2 and FIG. 3 is effected by pivoting of the upper and lower arms 18, 20 forming a linkage when in combination with brackets 17 and assembly 22. When in the retracted position as shown in FIG. 2, the assembly 22 and thus the platform 24 are tilted in a clockwise direction relative to the position depicted to FIG. 3. This provides for increased access and space in the kneehole area beneath the desk top 10 or work surface. To position the mechanism in the extended position as depicted in FIG. 3, the sliding bracket mechanism 16 is slid forward on the plate assembly 14. The upper and lower linkage arms 18 and 20 respectively are pivoted about their respective connecting pivot points. This causes the platform 24 to rise toward the level of the top of the desk top 10 and move in a counterclockwise manner relative to the position shown in FIG. 2. Importantly, the pivots on the bracket assembly 16 are spaced a greater distance than those pivots on the assembly 22. Alternatively, the length of the lower linkage arm 20 may be greater than the length of the upper linkage arm 18 or a combination of such construction features may be utilized to provide the described non-parallel linkage. This non-parallel linkage results in the relative movement of the platform 24 from the orientation depicted in FIG. 2 to the generally horizontal orientation as depicted in FIG. 3. Again, by using a non-parallel linkage of arms and pivots the orientation of platform 24 is changed from the position of FIG. 2 to the position of FIG. 3.

Thus, the keyboard platform assembly 22 is positioned in a horizontal work position when in the extended orientation of FIG. 3. By contrast when in the retracted position of FIG. 2 the platform assembly 22 is moved in a clockwise orientation which permits improved access and room in the kneehole beneath the work surface or desk top 10. Because of the described construction, the platform 24 does not and cannot maintain a fixed generally horizontal orientation upon pivoting of the linkage arms 18 and 20. Rather, the orientation is constantly changed depending upon the position of the linkage arms 18 and 20.

As an additional feature of the invention, the platform assembly 22 includes a mechanism, to be described below in greater detail, which permits the platform 24 to be independently rotated about an axis 28 independent of the movement of the linkage arms 18 and 20. Thus, there is depicted in FIGS. 2 and 3 a phantom position 24 for the platform assembly 22 due to utilization of the detent reorientation mechanism utilized to pivot the assembly 22 about axis 28. This provides flexibility for the user to custom position the platform 24.

Figure 5:
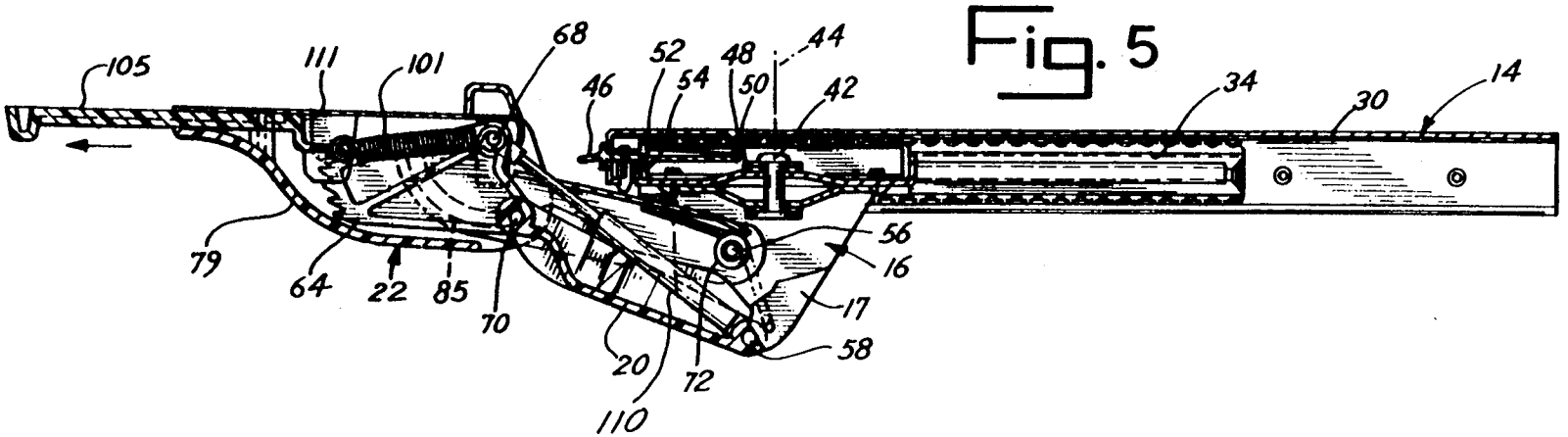
FIG. 5 is a side elevation, cross sectional view taken along the line 5—5 in FIG. 4 depicting the improved mechanism of the invention.
Figure 6:
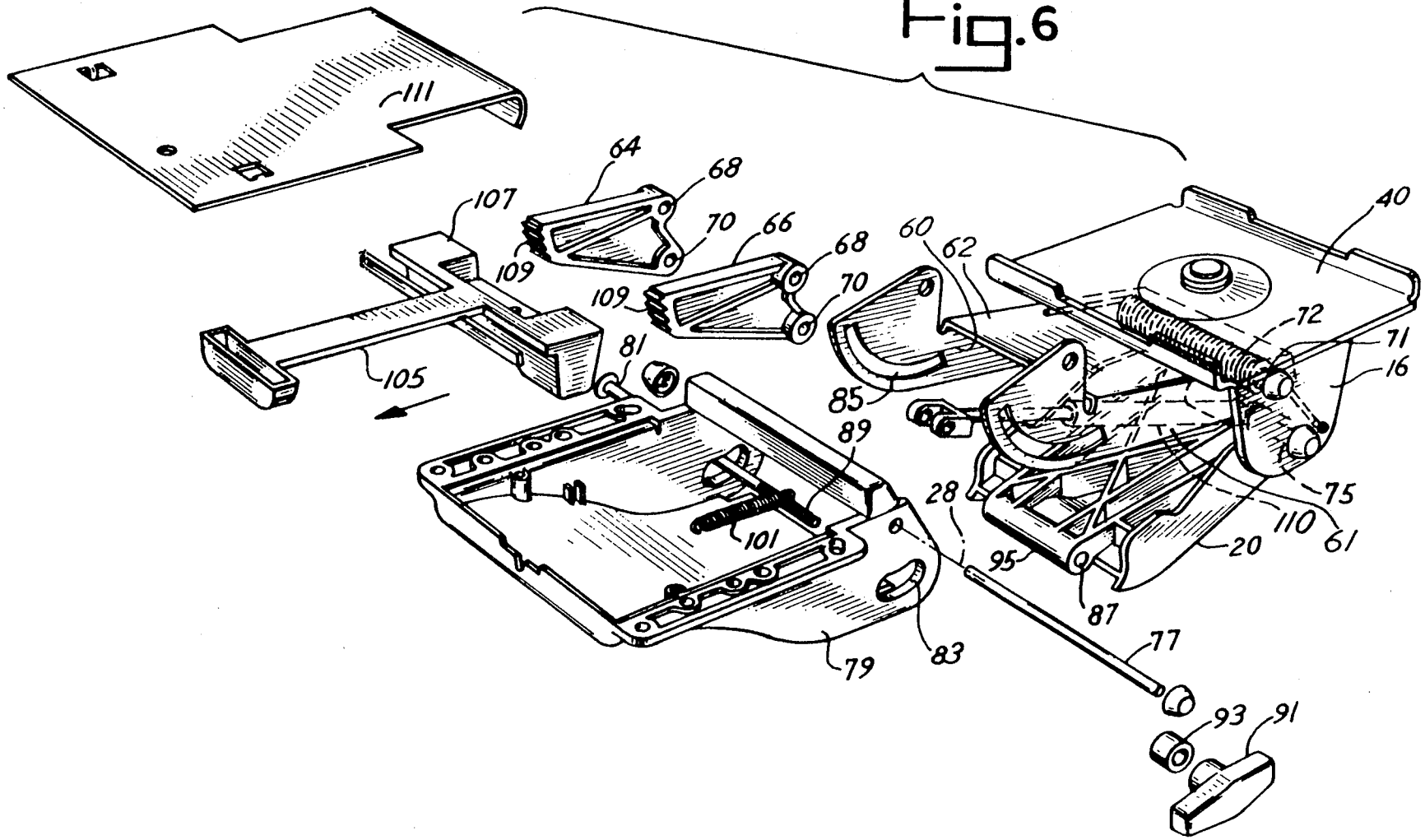
FIG. 6 is an exploded perspective view illustrating the component parts and there interconnection.

The specific construction for the various component parts is illustrated in greater detail and in FIGS. 1 and 4 through 6. Referring to those FIGURES, therefore, and initially referring to FIGS. 4 and 5 there is depicted in greater detail the plate assembly 14 which is designed for attachment to the lower side or underside 12 of a desk top 10. The plate assembly 14 includes a U-shaped cross section mounting plate 30 which fastens to the underside of 12 of the desk top 10. The mounting plate 30 includes parallel side, slide channels 32 and 34 as shown in FIG. 4. The parallel slide channels 32 and 34 include ball bearing tracks which slidably receive brackets 36 and 38 respectively. The brackets 36, 38 are riveted to a planar mounting plate 40 which is also depicted in FIG. 6. Thus, the mounting plate 40 is slidable in channels 32, 34 between a retracted and an extended position as the slide brackets 36 and 38 cooperate with the ball bearing channels 32 and 34. FIG. 2 depicts the retracted position. FIG. 3 depicts the extended position. Other slide mechanisms may be adopted.

The bracket 17 of bracket mechanism 16 is pivotally attached to the plate 40 by means of a vertical pivot pin or shaft 42 as depicted in FIG. 5. Thus, the depending brackets 17 may pivot about a vertical axis 44 in FIG. 5 thereby permitting the attached mechanism 16 to pivot about that axis 44.

As previously described the plate 40 and thus the entire mechanism attached to the plate 40 is slidable between the retracted position as depicted in FIG. 2 and the extended position as depicted in FIG. 3. A flexible plastic locking arm 46 is carried by the plate 40. The locking arm 46 includes an inward, upwardly extending tab 48 which cooperates with a depending projection 50 in the mounting plate 30 when ever the sliding plate 40 is in the extended or forward position. The locking arm 46 is flexible and is biased by cooperation of tab 48 and projection 50 so that a forward lip 52 associated with the locking arm 46 will be flexibly biased into engagement with edge 54 of the sliding plate 40 when that plate is in the forward position illustrated in FIGS. 3 and 5. This will retain the sliding plate 40 and thus the entire assembly in the extended or forward position shown in FIG. 3 preventing sliding movement to the retracted position. To release the plate 40, the locking arm 46 is manually moved or flexed upwardly in FIG. 5 against the flexible biasing force associated with the arm 46 to thereby release from the edge 54 and thus permit release of the platform or the mounting plate 40.

The sliding bracket 17 depends from the plate 40 and includes an upper first pivot 56 and a second, lower pivot 58. The pivots 56 and 58 each generally define an axis which are parallel to one another. The axes are generally spaced from one another with one above the other.

The first or upper linkage arm 18 is comprised of a pair of spaced generally parallel links 60, 61 connected by a cross member 62. Upper linkage arm 18 is pivotally connected to upper pivot 56. Nested between the links 60 and 61, but in a relatively lower position is the lower or second linkage arm 20. In the embodiment shown the second linkage arm 20 is a single linkage arm which connects from the lower pivot 58.

The linkage arms 18 and 20 both connect to spaced ratchet brackets 64 and 66 associated with the keyboard platform assembly. Each bracket 64 and 66 includes an upper pivot 68 and a lower pivot 70. Thus, the upper linkage arm 18 via the links 60 and 61 connects with and fits and the outside of the upper pivots 68. The lower linkage arm 20 fits in between the brackets 64 and 66 thereby spacing those brackets and also connects with the lower pivot 70. Again, note the links 60 and 61 also fit on the outside of the lower linkage arm 20. Thus, the lower linkage arm 20 is between the racket brackets 64 and 66 and on the outside of racket brackets 64, 66 are the links 60 and 61.

Importantly, the distance between the upper and lower pivots 56 and 58 is greater than the distance between the upper and lower pivots 68 and 70 to provide a non-parallel linkage. Alternatively, the distance between the lower pivots 58 and 70 may be greater than that between the upper pivots 56 and 68 or some combination thereof to provide a non-parallelogram in all orientations of a quadrilateral which connects the pivots 56, 58 70 and 68. The upper linkage arm 18 is attached to the bracket 17 by means of a rod 71 which is capped or headed at both ends and which extends through appropriate openings in the bracket 17 and arm 18. A spiral spring 72 fits around the rod 71. One end of the spiral spring 72 is attached to the bracket 17. The opposite end fits against the cross plate 62 to bias the cross plate 64 and links 60, 61 (arm 18) in the clockwise direction as viewed in FIGS. 2, 3 and 5, for example. The lower arm 20 is likewise attached and cooperative with the bracket 17 by means of a rod 75 which is also capped at both ends.

The spring 72 may be assisted or replaced by a compressible gas cylinder 110 in FIG. 5 which is positioned between pivots 68 and 58. Of course, other fluid or mechanical springs arrangements may be used to bias the linkage arms 18,20.

The opposite end of each linkage arm 18, 20 is likewise fixed or retained in engagement with the appropriate racket brackets 64, 66 by means of rods. Thus, a rod 77 which is capped at both ends fits through a keyboard platform support member 79 and then through the links 60 and 61 as well as openings of the upper pivot 68 in the racket brackets 64, 66. A second rod 81 fits through arcuate slots 83 in the member 79 and then passes through second arcuate slots 85 in the links 60 and 61. The rod 81 thus passes through the pivot openings 70 and an opening 87 associated with the end of lower arm 20.

The rod 81 has a slightly different construction. That is the rod 81 includes a headed end 80 and a threaded end 89 cooperative with a rotatable handle 91. A spacer 93 fits against the handle 91. Spacer 93 fits through the slot 83 and is slidable in the slot 83. The handle 91 may be tightened on the threaded end 89 to draw the headed and 80 and spacer 93 tightly against the links 60, 61 tightening that links 60, 61 against the end 95 of the lower arm 20 through which the passage 87 is defined and against the racket brackets 64, 66. In this manner, the linkage arms 18 and 20 may be held in a fixed or locked position.

The bracket mechanism 79 is designed to be pivotable about the axis defined by the rod 77. It is also designed to be rigidly connected and disconnected from the brackets 64 and 66. That is, a coil spring 101 connects from the rod 81 at one end to a locking bar 105 which is slidably mounted in the bracket mechanism 79. The locking bar 105 includes a locking rib 107 which engages in appropriate detent teeth 109 associated with the brackets 64 and 66. Thus, by pulling in the direction of the arrow in FIG. 6 on the locking bar 105 against the force of the spring 101 which is attached to the bar 105, the rib 107 is disengaged from the teeth 109. The mechanism 79 may then be pivoted about the axis of rod 77 to reorient the mechanism 70 and the attached planer plate 111 which fits on the mechanism 79. The plate 111 supports the platform 24 as previously described. In review, it is possible to adjust the tilt of the platform 24 by pulling on the locking bar mechanism 105 and pivoting the assembly 79.

It is to noted once again that the quadrilateral defined by connecting the pivots 56, 58, 68, 70 is not a parallelogram and in the preferred embodiment is arranged to provide for effective clockwise movement of the platform 24 as the linkage is moved to the position which is the storage position.

It is possible to vary the construction of the invention by providing additional elements or by eliminating certain elements without departing from the spirit or scope of the invention. For example, the pivot shaft or pin 42 may be eliminated to eliminate the pivoting operation associated therewith. Further, it is possible to eliminate the mechanism associated with the locking bar 105. Thus, the platform would be in a horizontal position when extended and in the space saving position depicted in FIG. 2 when retracted. Of course, by varying the relative length of the upper and lower links it is possible to accommodate or vary the improved access or knee room in the region beneath the desk. Thus, while there has been set forth the preferred embodiment of the invention, it is understood that the invention is to be limited only by the following claims and their equivalents.

What is claimed:

1. An improved adjustable support mechanism for a keyboard platform assembly of the type including a platform supported by said support mechanism, said platform associated with a work surface, said mechanism comprising in combination:

a mounting plate for attachment to the underside of the work surface;

a slide assembly cooperative with the mounting plate and slidable between an extended position and a retracted position;

a first bracket means projecting downwardly from the slide assembly, said first bracket means including a first upper pivot and a first lower pivot;

a forward platform for support of a keyboard;

a second bracket means projecting downwardly from the forward platform, said second bracket means including a second upper pivot and a second lower pivot;

a first linkage arm between the first and second upper pivots;

a second linkage arm between the first and second lower pivots, whereby the linkage arms and pivots provide non-parallel unequal connecting linkages between the pivots, said arms defining means for tilting the platform from a horizontal orientation to a non-horizontal orientation as the platform is moved by the pivoting of the linkage arms;

spring means for biasing the linkage arms about the axes of pivots wherein the spring means comprises a compressible fluid cylinder connected between the pivots of the first and second bracket means;

wherein the first linkage arm comprises a pair of spaced arms and said second linkage arm comprises a single arm intermediate the spaced arms.

2. The improved adjustable support mechanism of claim 1 wherein said spaced arms are parallel one to the other.

3. The improved adjustable support mechanism of claim 1 or 2 further comprising a cross member integrally connecting said spaced arms to one another.

4. An improved adjustable support mechanism for a keyboard platform assembly of the type including a platform supported by said support mechanism, said platform associated with a work surface, said mechanism comprising in combination:

a mounting plate for attachment to the underside of the work surface;

a first bracket means projecting downwardly from the mounting plate, said first bracket means including a first upper pivot and a first lower pivot;

a forward platform for support of a keyboard;

a second bracket means projecting downwardly from the forward platform, said second bracket means including a second upper pivot and a second lower pivot;

a first linkage arm between the first and second upper pivots, said first linkage arm having a first length; and a second linkage arm between the first and second lower pivots, said first and second linkage arms having different lengths, whereby the linkage arms and pivots provide unequal non-parallelogram connecting linkages between the pivots, said arms defining means for tilting the platform from a horizontal orientation to a non-horizontal orientation as the platform is moved by the pivoting of the linkage arms.

5. The improved adjustable support mechanism of claim 4 including platform orientation adjustment means connecting the platform with the second bracket means.

6. The improved adjustable support mechanism of claim 4 wherein the platform orientation adjustment means comprises a pivot mechanism connecting the second bracket means to the platform for pivoting said platform about said second upper pivot.

7. The improved adjustable support mechanism of claim 4 wherein the first linkage arm comprises a pair of spaced arms, the spaced arms being parallel to one another, and said second linkage arm comprises a single arm intermediate the spaced arms.

8. The improved adjustable support mechanism of claim 4 wherein the first linkage arm comprises a pair of spaced arms and said second linkage arm comprises a single arm intermediate the spaced arms.

9. The improved adjustable support mechanism of claim 7 or 8 further comprising a cross member integrally connecting said spaced arms to one another.

10. The improved adjustable support mechanism of claim 4 further comprising a vertical pivot axis connecting means between the mounting plate and the underside of the work surface, for pivoting the mechanism beneath said work surface.

11. The improved adjustable support mechanism of claim 4 wherein the forward platform is pivotable about the second upper pivot and further including detent means for locking the platform into any one of a series of detent positions whereby the platform may be maintained in said position for support of a keyboard and the like.

12. The improved adjustable support mechanism of claim 4 further comprising spring means for biasing the linkage arms toward the extended position.

13. The improved adjustable support mechanism of claim 4 wherein the first linkage arm comprises a pair of parallel arms spaced one from the other by a cross member and further including spiral spring means having one end biased against the cross member and other end biased against the first bracket means to bias the first linkage arms toward an extended position.

14. The improved adjustable support mechanism of claim 4 wherein said spring means comprises a compressible fluid cylinder connected between the pivots of the first and second bracket means.

15. The improved adjustable support mechanism of claim 4 further comprising means for locking the linkage arms in a fixed pivot position.

16. The improved adjustable support mechanism of claim 15 wherein said means for locking the linkage arms in a fixed pivot position comprises means for frictionally locking the first linkage arm and the second linkage arm one against the other.

17. An improved adjustable support mechanism for a keyboard platform assembly of the type including a platform supported by said support mechanism, said platform associated with a work surface, said mechanism comprising in combination:

a mounting plate for attachment to the underside of the work surface;

a first bracket means projecting downwardly from the mounting plate, said first bracket means including a first upper pivot and a first lower pivot;

a forward platform for support of a keyboard;

a second bracket means projecting downwardly from the forward platform, said second bracket means including a second upper pivot and a second lower pivot;

a first linkage arm between the first and second upper pivots;

a second linkage arm between the first and second lower pivots, whereby the linkage arms and pivots provide non-parallel unequal connecting linkages between the pivots, said arms defining means for tilting the platform from a horizontal orientation to a non-horizontal orientation as the platform is moved by the pivoting of the linkage arms.

18. The improved adjustable support mechanism of claim 17 including platform orientation adjustment means connecting the platform with the second bracket means.

19. The improved adjustable support mechanism of claim 18 wherein the platform orientation adjustment means comprises a pivot mechanism connecting the second bracket means to the platform for pivoting said platform about said second upper pivot.

20. The improved adjustable support mechanism of claim 17 wherein the first linkage arm comprises a pair of spaced arms, the spaced arms being parallel to one another, and said second linkage arm comprises a single arm intermediate the spaced arms.

21. The improved adjustable support mechanism of claim 17 wherein the first linkage arm comprises a pair of spaced arms and said second linkage arm comprises a single arm intermediate the spaced arms.

22. The improved adjustable support mechanism of claim 20 or 21 further comprising a cross member integrally connecting said spaced arms to one another.

23. The improved adjustable support mechanism of claim 17 further comprising a vertical pivot axis connecting means between the mounting plate and the underside of the work surface, for pivoting the mechanism beneath said work surface.

24. The improved adjustable support mechanism of claim 17 wherein the forward platform is pivotable about the second upper pivot and further including detent means for locking the platform into any one of a series of detent positions whereby the platform may be maintained in said position for support of a keyboard and the like.

25. The improved adjustable support mechanism of claim 17 further comprising spring means for biasing the linkage arms toward the extended position.

26. The improved adjustable support mechanism of claim 17 wherein the first linkage arm comprises a pair of parallel arms spaced one from the other by a cross member and further including spiral spring means having one end biased against the cross member and other end biased against the first bracket means to bias the linkage arms toward an extended position.

27. The improved adjustable support mechanism of claim 17 further comprising means for locking the linkage arms in a fixed pivot position.

28. The improved adjustable support mechanism of claim 27 wherein said means for locking the linkage arms in a fixed pivot position comprises means for frictionally locking the first linkage arm and the second linkage arm one against the other.

* * * * *